US006286791B1

(12) United States Patent
Young et al.

(10) Patent No.: US 6,286,791 B1
(45) Date of Patent: Sep. 11, 2001

(54) RAILROAD SPRING WING FROG WITH HOLD-OPEN AND SHOCK DAMPENING ELEMENTS

(75) Inventors: Keith Young, Naperville; Stephen R. Kuhn, Richton Park, both of IL (US)

(73) Assignee: ABC-NACO Inc., Downers Grove, IL (US)

( * ) Notice: Subject to any disclaimer, the term of this patent is extended or adjusted under 35 U.S.C. 154(b) by 0 days.

(21) Appl. No.: 09/521,338

(22) Filed: Mar. 9, 2000

(51) Int. Cl.[7] ..... E01B 7/00
(52) U.S. Cl. ..... 246/382; 246/276; 246/389
(58) Field of Search ..... 246/257, 274, 246/275, 276, 382, 387, 389, 392, 454, 458, 468

(56) References Cited

U.S. PATENT DOCUMENTS 253,177 * 2/1882 Breen ..... 246/276
398,975 * 3/1889 Price ..... 246/389
514,119 * 2/1894 Dodgson ..... 246/275
515,361 * 2/1894 Price ..... 246/383
926,211 * 6/1909 Roach ..... 246/389
930,709 * 8/1909 Whiteman ..... 246/257
4,953,814 * 9/1990 Oswald et al. ..... 246/382
5,810,298 * 9/1998 Young et al. ..... 246/276

* cited by examiner

*Primary Examiner*—S. Joseph Morano
*Assistant Examiner*—Frantz F. Jules
(74) *Attorney, Agent, or Firm*—Thomas S. Baker, Jr.

(57) ABSTRACT

An improved railroad trackwork spring wing frog assembly having a selectively releasable hold-open subassembly for the spring wing rail is provided with a combined compressible shock absorber and compression spring that are functionally connected to the assembly spring wing rail and to the assembly base plate, and that function to generate an opposing force in connection with opening movement of the spring wing rail and an augmented force in connection with closing movement of the spring wing rail.

3 Claims, 4 Drawing Sheets

FIG. 2
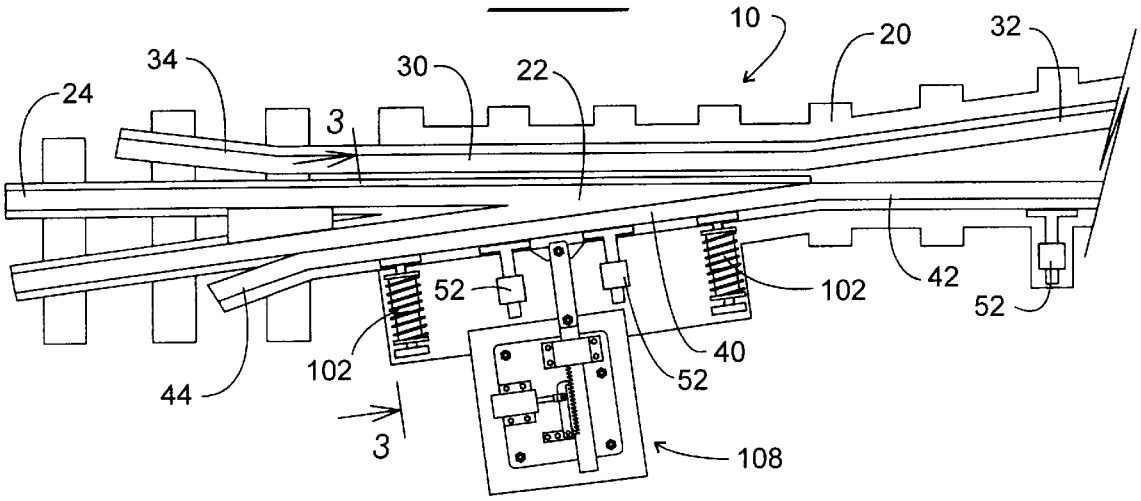
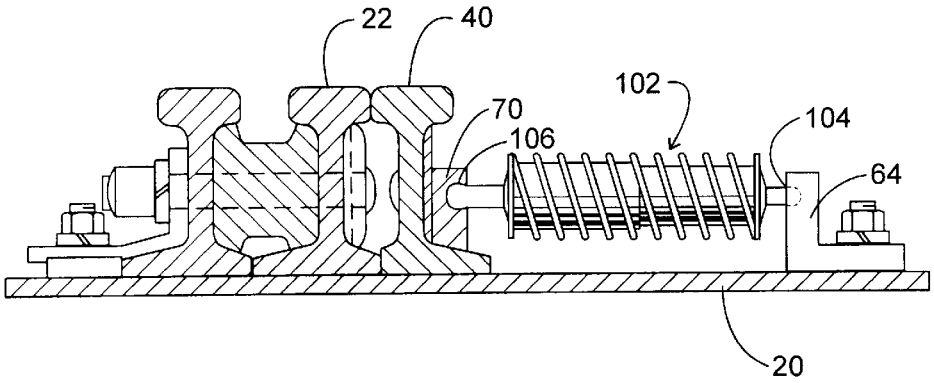
FIG. 3

RAILROAD SPRING WING FROG WITH HOLD-OPEN AND SHOCK DAMPENING ELEMENTS

CROSS-REFERENCES

None.

FIELD OF THE INVENTION

This invention relates generally to railroad trackworks, and particularly concerns an improved trackwork frog assembly of the spring wing rail-type which is principally used at railroad trackwork turn-outs from main line track.

BACKGROUND OF THE INVENTION

A railroad frog is a device which is installed at the intersection of two running rails to permit the flanges of railroad car wheels moving along one of the rails to pass across the other rail. The frog supports the car wheels as they pass over the missing rail tread surface between the throat and the point of the frog, and also provides flangeways for the flanges of those car wheels which pass through the frog.

A railroad spring wing rail frog assembly typically includes a rigid wing rail, which is substantially aligned with a long point or heel rail element connected to a turnout traffic rail, and a relatively movable spring wing rail which is substantially aligned with a short point or heel rail element that is connected to a main line traffic rail. The movable wing rail is mounted with a yieldable free end, provides a substantially continuous support for the wheels of a rail car passing along the main line track, and often is closure-biased toward the frog long point rail by including a compression spring-type wing rail-closer element to the frog assembly. The movable wing rail, sometimes called a spring wing rail, has inherent lateral resiliency and is moved laterally away from the long point rail to provide a wheel flangeway between the long point rail and the spring wing rail when a railcar wheel flange traversing the rigid wing rail engages the spring wing rail free end and forces or causes that rail to be moved laterally to a full open position. After the last co-operating railcar wheel has passed through the assembly, the compression forces induced in the wing rail by bending and by the added rail-closer element cause the movable wing rail to be forcefully moved into its normal abutting relationship with the frog assembly long point rail.

U.S. Pat. No. 4,624,428, issued in the name of Frank, U.S. Pat. No. 5,544.848, issued in the names of Kuhn et al., and U.S. Pat. No. 5, 810,298, issued in the names of Young at al., all assigned to the assignee of this application, each disclose details of representative railroad spring wing rail frog assemblies known and utilized in the United States. While such frog assemblies have satisfactorily fulfilled different railroad trackwork application requirements, it has been observed that in instances in which the frog assemblies include a hold-open subassembly (sometimes also referred to as a holdback device) the frogs have been subjected to spring wing rail "overshooting" as a result of repeated, large-amplitude impact forces being imposed on the spring wing rail by the wheel flanges of railcar wheels moving through the assembly—especially at higher train velocities. The "overshooting" phenomenon can result in both frog assembly excessive wear and in possible substantial damage to the hold-open device.

We have discovered a new and useful railroad trackwork frog assembly construction which will improve frog assembly performance by eliminating the unwanted spring wing rail overshooting that often results from repeated high-impact forces being applied to she spring wing rail by successive railcar wheel flanges.

Other objects and advantages of the present discovery will become apparent during a careful consideration of the invention summary, description of the drawings, and detailed description which follow.

SUMMARY OF THE INVENTION

The novel railroad trackwork frog assembly of this invention is essentially comprised of a base plate element, a fixed wing rail element secured to the base plate element, a movable spring wing rail element mounted on the base plate element and having a free end portion, a spring wing rail hold-open element connected to the spring wing rail and to the base plate element, at least one shock absorber element also connected to the base plate element and to the movable wing rail element, and a coil compression spring element mounted on the shock absorber in surrounding and co-axial relation. Basically, the shock absorber element, which may be either a pneumatic-type shock absorber or a hydraulic-type shock absorber, functions to impose motion-resistance forces on the spring wing rail as it is being moved toward its fully-open condition, but does not impose any significant motion-retarding forces on the spring wing rail as it is being moved toward its fully-closed condition. The heavy-duty compression spring is combined with the shock absorber element to overcome friction forces that otherwise would tend to retard closing of the spring wing rail after a train has passed through the frog assembly.

In addition, the frog assembly may optionally include one or more slide-horn and hold-down subassemblies that function to control or maintain proper spring wing rail cross-section vertical orientation at all times during spring wing rail lateral movement, and may also optionally include an outrigger roller and inclined ramp subassembly of the type disclosed in U.S. Pat. No. 5,544,848.

DESCRIPTION OF THE DRAWINGS

FIG. 2 is a schematic plan view, at a larger scale, of the railroad spring wing rail frog assembly embodiment included in the trackwork intersection of FIG. 1;

FIG. 3 is a section view taken at line 3—3 of FIG. 2;

DETAILED DESCRIPTION

Figure 1:
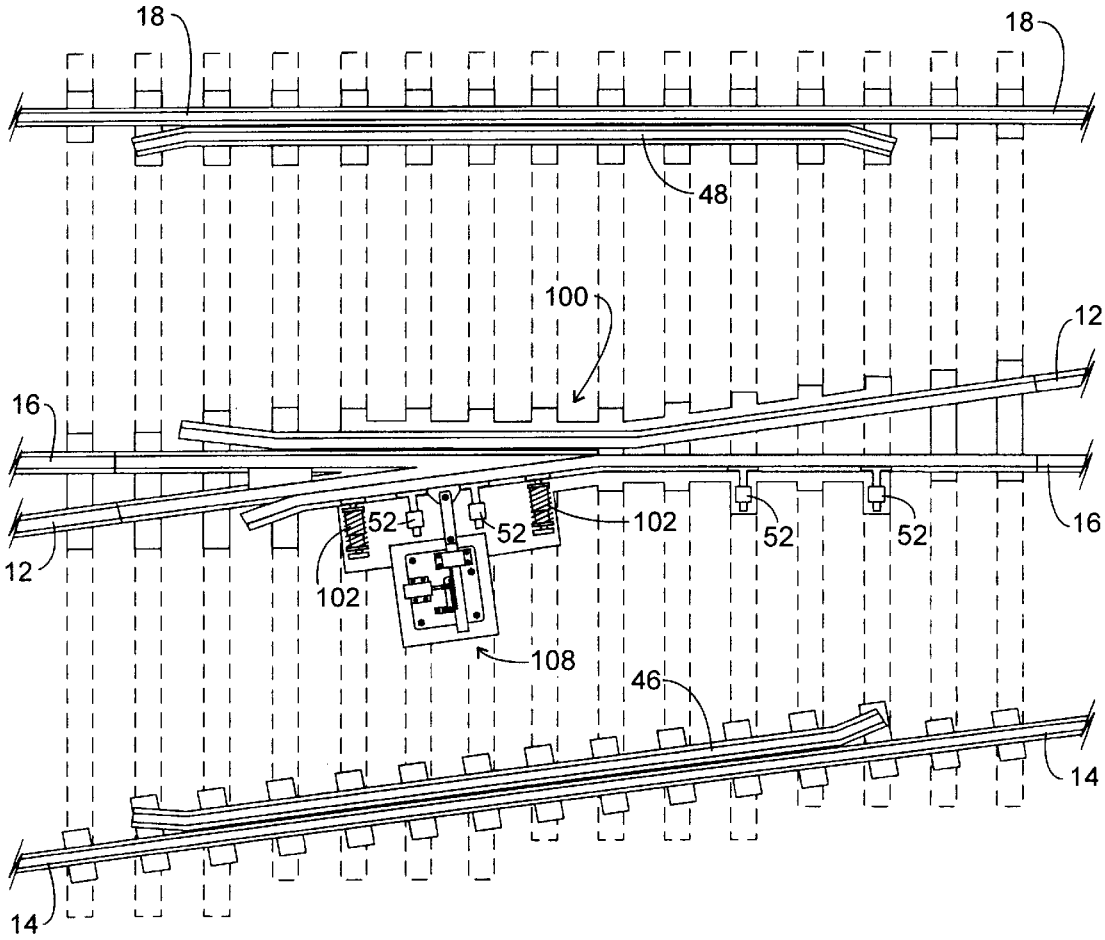
FIG. 1 is a plan view of a railroad trackwork turnout intersection having a preferred embodiment of the present invention.

Referring to FIGS. 1 and 2, a left-hand spring frog assembly 100 is shown inserted in one rail 12 of a pair of turnout rails 12, 14 and in one rail 16 of a pair of mainline rails 16, 18. Spring wing rail frog assembly 100 is mounted on a base plate element 20 which provides a level foundation for the frog assembly invention and which maintains the elements which comprise the frog assembly in their proper inter-relationship during shipping, subsequent installation, and operation in a railroad trackwork. Frog assembly 100 is functionally positioned to permit flanged railcar wheels riding along rail 12 to cross rail 16 and flanged railcar wheels riding along rail 16 to cross rail 12. A conventional switch stand for directing railcars from rail pair 12, 14 to rail pair 16, 18 and vice versa is necessary for the trackwork but does not comprise any part of invention 100.

As illustrated in FIG. 2, spring wing rail assembly 10 has a V-point element 22 mounted on base plate 20 and has a rail end 24 which upon frog installation is joined, as by welding, to turnout line rail 12 to provide a connection for that rail to frog assembly 100. An included rail end 26 is joined, as by welding, to mainline rail 16 to connect that rail to frog assembly 100.

The generally-curved, fixed wing rail element 30 of frog assembly 10 has an end 32 that is connected on frog installation to a section of turnout rail 12. The end 34 of fixed wing rail element 30 is preferably flared so that the flange of a railcar wheel moving through the assembly from the FIG. 2 left will not abruptly strike the wing rail free end. Also, fixed wing rail element 30 is rigidly secured to base plate element 20 by conventional means such as plate clips (not shown). Thus, wing rail element 30 is a relatively immovable member of frog assembly 100.

The yieldably-mounted spring wing rail element 40, which is the primary movable member of frog assembly 100, has an end 42 that upon installation is joined to a section of mainline rail 16. Element 40 also has a flared end 44 to avoid being accidentally struck by the flange of a railcar wheel moving toward V-point rail element 22 from the FIG. 2 left. It should be noted that spring wing rail 40 at its principal body section and at its free end 44 is not fixedly secured to base plate element 20 either by conventional plate clips or otherwise. Lateral movement of spring wing rail element 40 relative to base plate 20, however, is resisted by sliding friction forces sourced in the weight of the spring wing rail and the weight of railcars riding on the spring wing rail.

When the flange of a car wheel engages spring wing rail 40 at its free end 44 and causes it to move laterally so that a flangeway is provided between V-point 22 and spring wing rail 40, rail 40 is basically stressed and flexed from the point of wheel engagement to where it is first rigidly secured to base plate element 20, usually at an assembly spacer block (not shown). Spring wing rail element 40 is acting essentially as a cantilevered beam.

The railroad trackwork installation shown in FIG. 1 also typically includes a pair of conventional guard rail elements 46, 48 having flared ends which are positioned at turnout rail 14 and at mainline rail 18, each in spaced-apart relation to the adjacent rail by a distance that is slightly greater than the standard railcar wheel flange thickness, respectively.

In addition, and as shown in FIGS. 1 and 2, the railroad spring frog assembly 100 typically includes a selectively releasable hold-open element 108 and one or more shock absorber subassembly 102 in its construction and also, optionally, one or more conventional hold-down subassembly 52, each such subassembly 102 being functionally connected to spring wing rail 40 and to base plate element 20. Hold-open element 108 generally is a device of the type disclosed in U.S. Pat. No. 5,806,810, issued Sep. 15, 1998 in the names of Young et al. and assigned to the assignee of this patent application, or disclosed in co-pending Applications for U.S. Letters Patent Ser. Nos. 09/251,841 filed Feb. 17, 1999 and 09/251,620 filed Feb. 17, 1999 also assigned to the assignee of this patent application.

While in some applications a single shock absorber assembly 102 may be effective to prevent spring wing rail overshooting, in the FIGS. 1 and 2 frog assembly construction a pair of spaced-apart shock absorber subassemblies are provided for the purpose of eliminating repeated spring wing rail "overshooting" that would otherwise occur as a consequence of the impact forces imposed by the successive railcar wheels of a train passing through the frog assembly.

Hold-down subassemblies 52 function, during instances when a railcar wheel flange engages spring wing rail 40 and causes lateral displacement of rail 40, to limit upwards vertical movement of the rail and yet permit rail lateral movement.

Each included shock absorber element 102 is combined with a surrounding co-axial, heavy-duty compression spring element 53, and the shock absorber end extremes are connected to spring wing rail 40 and base plate element 20 through the semi-spherical slip joints 104 and 106, with the semi-spherical socket portions of the semi-spherical slip joints being provided in mounting brackets 64 and 70, respectively. Alternatively, more conventional tang and clevis connections may be utilized in lieu of semi-spherical slip joints 104 and 106. The hold-open element included in the frog assembly is referenced by the numeral 108.

Figure 4:
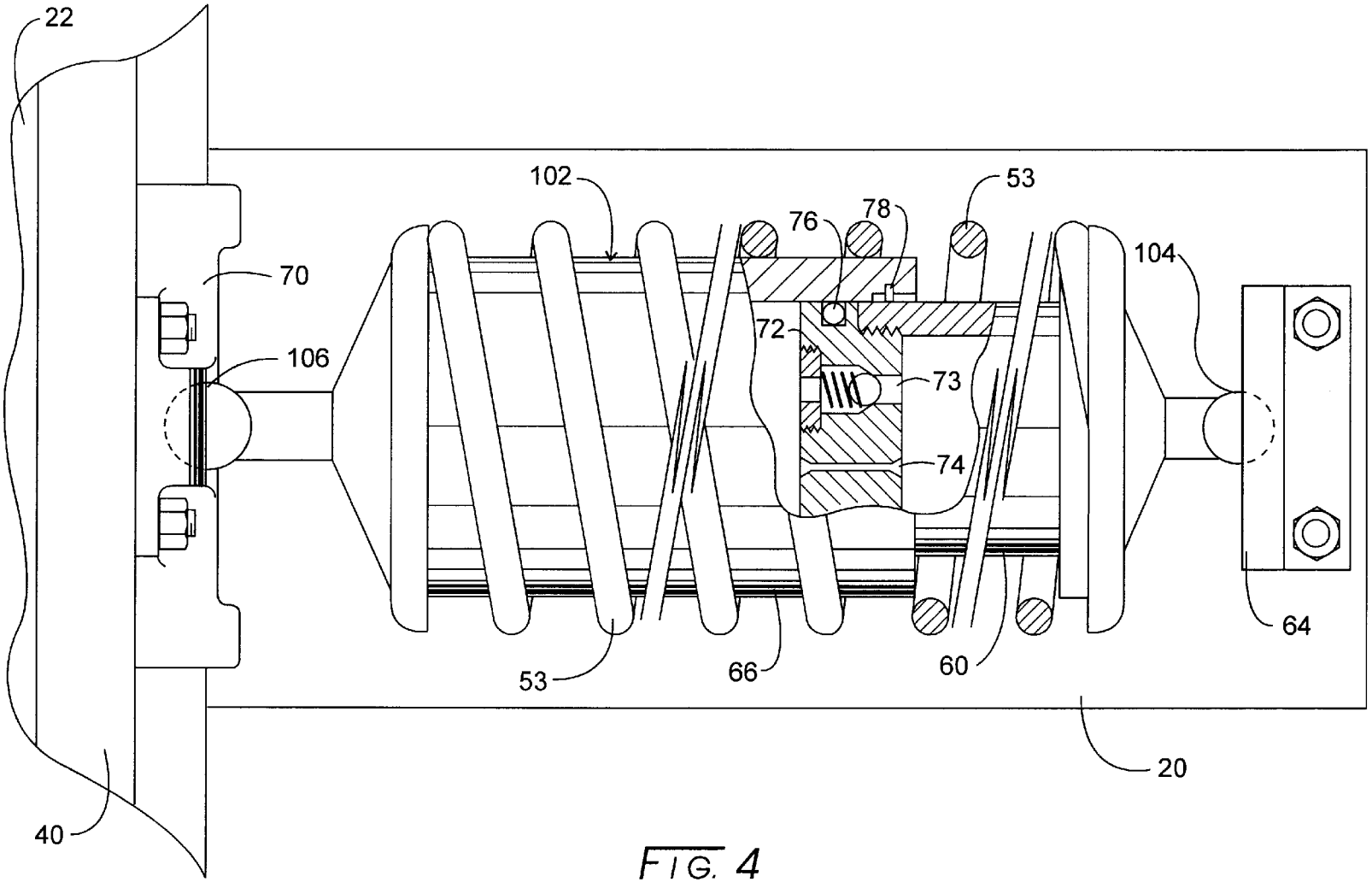
FIG. 4 is an enlarged plan view, partially sectioned, of the pneumatic-type shock absorber and compression spring elements combination of FIGS. 1 through 3.

In FIG. 4 we provide details of pneumatic-type shock absorber subassembly 102 including its connections to spring wing rail element 40 and to base plate element 20. Basically, the hollow, small-diameter end 60 of shock absorber 50 co-operates through a tang and clevis pivot connection 62 with the mounting bracket 64 that is bolted to assembly base plate element 20. The hollow, large-diameter end 66 of shock absorber assembly 50 is connected to spring wing rail 40 through a semi-spherical slip joint 106 and mounting bracket 70 and of a co-operating cylinder end 114 that is connected to base plate element 20 through a semi-spherical slip joint 104 and mounting bracket 64. Because shock absorber subassembly 110 includes heavy-duty compression spring element 53 in surrounding and co-axial relation to the piston and cylinder ends 112 and 114, such shock absorber ends 112 and 114 are each provided with a large-diameter integral flange 116 against which an end of spring element 53 will abut. Pivot connections 104 and 106 are provided to achieve proper shock absorber self-alignment throughout the range of motion of the invention spring wing rail element.

Small-diameter end 60 of shock absorber element 102 is provided with a piston-head closure member 72 having an integral one-way, spring-biased check valve 73 and an integral orifice passageway 74. Basically, check valve 73 is sized to have a large flow rate at a given pressure differential for its one-way flow in comparison to the flow rate of orifice passageway 74 at the same pressure differential. Orifice passageway 74 is provided in shock absorber subassembly 50 primarily for the purpose of achieving long-term pressure equalization between the interior chambers of shock absorber ends 60 and 66.

Also included in subassembly 102 are conventional piston head O-ring pressure seal 76 and conventional debris wiper ring 78. Not shown in the drawings is a conventional valved inlet port that must be provided in shock absorber subassembly 102 for the purpose charging the shock absorber interior with pressurized air or other gaseous fluid.

Note also that the ends of shock absorber 102 are provided with integral, large-diameter flanges 116 that serve as abutments for the ends of heavy-duty compression spring element 53. Basically, embodiment 100 of the spring wing rail frog assembly of the present invention is utilized in applications wherein increased friction is encountered in connection with the opening and closing of spring wing rail 40 such that an increased closing force is desired. Such is provided by the additionally included heavy-duty compression spring element 53 of shock absorber assembly embodiment 102.

Figure 5:
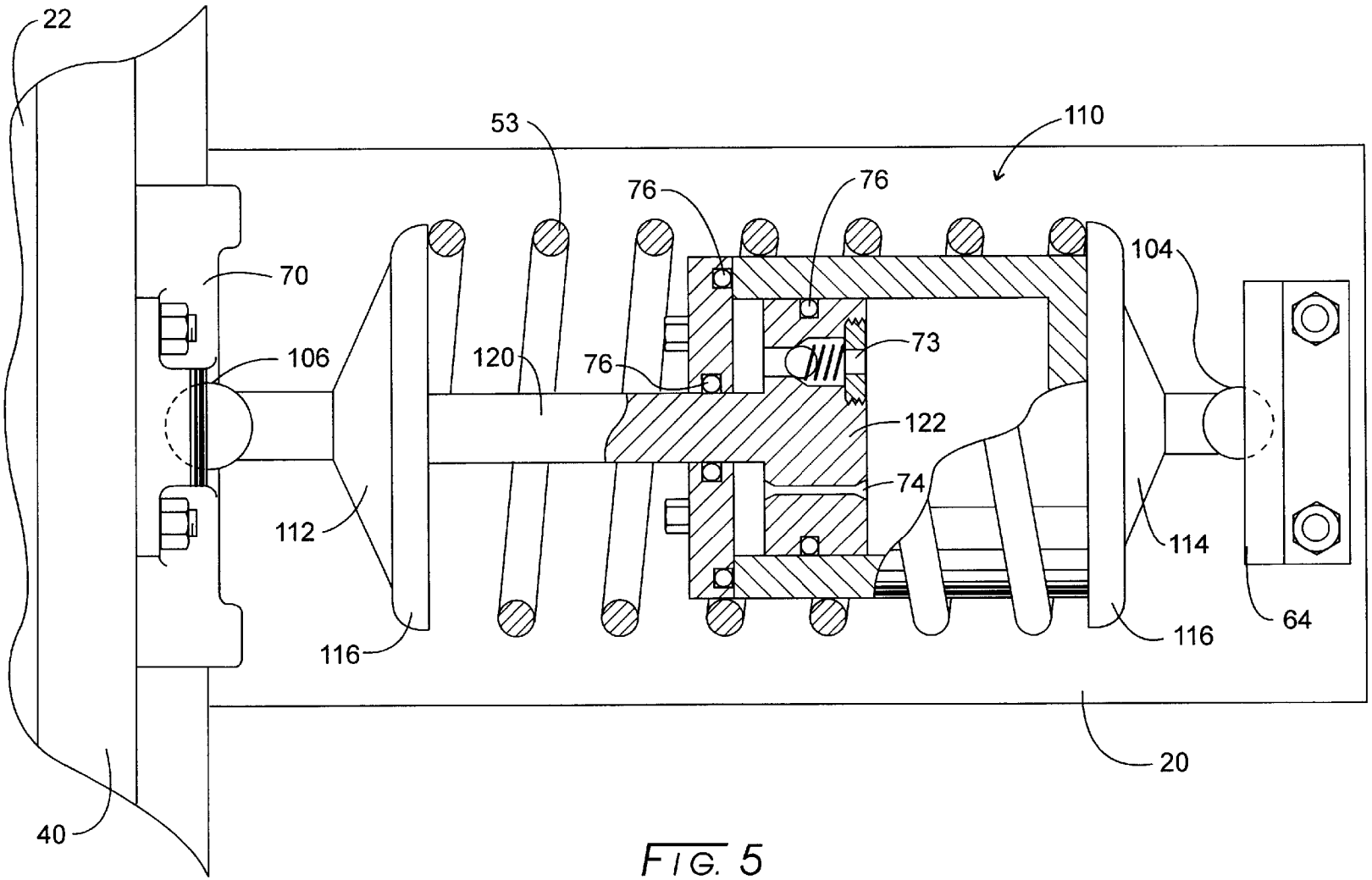
FIG. 5 is an enlarged plan view of an alternate hydraulic-type shock absorber element that may be utilized in the practice of the instant invention.

In FIG. 5 we provide schematic construction details of a hydraulic-type shock absorber subassembly 110 that may be utilized in the practice of the present invention, particularly when the overshoot impact loads imposed on the frog assembly spring wing rail are especially large in magnitude. As shown in FIG. 6, subassembly 110 is basically comprised of a hydraulic piston end 112 having an integral piston rod 120 and attached piston 122 and of co-operating hydraulic cylinder end 114. Piston 122 is provided with an integral one-way check valve 73 and an integral orifice passageway 74 and also the O-ring seals 76.

By further including the co-axial and surrounding compression spring 53 in element 102 we are able to provide a frog assembly with subassembly functions that previously were achieved with two separate subassemblies each with an individual function, with a reduction of separate component mounting positions, and also with a reduction in number of required component parts.

Other component shapes, sizes, and materials may be substituted for the component shapes, sizes, and materials described above to obtain the advantages of this invention and without departing from the claimed scope of the invention.

We claim as our invention the apparatus defined by the claims which follow.

What is claimed is:

1. In a railroad trackwork spring wing rail frog assembly having a relatively fixed wing rail and a laterally movable spring wing rail, in combination:

a base plate element;

a spring wing rail element supported by, and laterally movable with respect to, said base plate element;

a selectively releasable hold-open element pivotally connected to said spring wing rail element and to said base plate element;

a shock absorber element secured to said base plate element and to said spring wing rail element; and a heavy-duty spiral compression spring rail-closer element mounted coaxially and in surrounding relation to said shock absorber element, and functioning cumulatively with respect to said shock absorber element, said shock absorber element generating an opposing force in connection with opening movement of said spring wing rail element and not generating an assisting force in connection with closing movement of said spring wing rail element, and said heavy-duty compression spring rail-closer element generating an opposing force in connection with opening movement of said spring wing rail element and an assisting force in connection with closing movement of said spring wing rail element.

2. In a railroad trackwork spring wing rail frog assembly having a relatively fixed wing rail and a laterally movable spring wing, in combination:

a base plate element;

a spring wing rail element supported by, and laterally movable with respect to, said base plate element;

a selectively released hold-open element pivotally connected to said spring wing rail element and to said base plate element;

a shock absorber element secured to said base plate element and to said spring wing rail element and having a cylinder end and that slidably co-operates with said cylinder end; and a heavy-duty spiral compression spring rail closer element mounted coaxially and in surrounding relation to said shock absorber element, said shock absorber element generating an operating force in connection with opening movement of said spring wing rail element and not generating an assisting force in connection with closing movement of said spring wing rail element, said heavy-duty compression spring element generating an opposing force in connection with opening movement of said spring wing rail element and an assisting force in connection with closing movement of said spring wing rail element, wherein said shock absorber element is provided with a cylinder end and with a piston end that slidably co-operates with said cylinder end and each of said shock absorber ends being provided with an abutment flange against which said co-axial and surrounding heavy-duty compression spring rail closer element abuts.

3. The invention defined by claim 2, and wherein said shock absorber element cylinder and piston ends are each provided with a semi-spherical slip joint connector half, each said semi-spherical slip joint connector half co-operating with a complementary semi-spherical slip joint connector half rigidly connected to a different one of said spring wind rail element and said base plate element.

* * * * *